US005819570A

United States Patent [19]

Mori et al.

[11] Patent Number: 5,819,570

[45] Date of Patent: Oct. 13, 1998

[54] MOTOR DRIVEN PORTABLE CRIMPER HAVING A DETECTION MECHANISM TO AUTOMATICALLY TURN OFF THE MOTOR

[75] Inventors: Katsuhisa Mori; Yoshihiro Nakagome; Yuji Nakajima, all of Osaka, Japan

[73] Assignee: Nichifu Terminal Manufacture, Osaka, Japan

[21] Appl. No.: 957,328

[22] Filed: Oct. 24, 1997

[30] Foreign Application Priority Data

Oct. 30, 1996 [JP] Japan ..... 8-305605
Oct. 30, 1996 [JP] Japan ..... 8-305606

[51] Int. Cl.[6] ..... H01R 43/042

[52] U.S. Cl. ..... 72/21.3; 72/409.06; 72/409.1; 72/452.7; 72/424; 29/715

[58] Field of Search ..... 72/20.2, 21.3, 72/409.06, 409.13, 409.14, 409.4, 409.01, 409.1, 452.7, 424; 29/715

[56] References Cited

U.S. PATENT DOCUMENTS 3,423,815 1/1969 Spangler ..... 29/715
5,697,146 12/1997 Inoue ..... 72/21.3

FOREIGN PATENT DOCUMENTS 9-7726 1/1997 Japan ..... 72/409.06
9-7727 1/1997 Japan ..... 72/409.06
9-35846 2/1997 Japan ..... 72/409.06

*Primary Examiner*—Daniel C. Crane
*Attorney, Agent, or Firm*—Edwin E. Greigg; Ronald E. Greigg

[57] ABSTRACT

A crimping station of a motor-driven portable crimper (A) has a movable head driven by a motor (M) to reciprocate straight towards and away from a fixed anvil. An automatic switch will automatically stop the motor upon detection of the movable head retracted from or having approached the anvil, so that the head and other members stand still for a while relative to the fixed anvil to allow the wire end to be inserted readily into the contact and then the contact thus crimped can easily be withdrawn from the crimping station. A manual switch is operable to restart the motor and resume the crimping process. A blind plate attached to and outside the frame is disposed near the crimping station so as to inhibit a user from erroneously inserting wire ends to the contacts which have not arrived at the station.

5 Claims, 7 Drawing Sheets

MOTOR DRIVEN PORTABLE CRIMPER HAVING A DETECTION MECHANISM TO AUTOMATICALLY TURN OFF THE MOTOR

BACKGROUND OF THE INVENTION

The present invention relates to a motor-driven portable crimper capable of being held by hand and manually controlled to crimp and secure electric contacts or terminals on the ends of wires or the like, wherein the contacts are made of a ductile metal plate.

The prior art tools of this type comprise in general a fixed member of a concave and jaw-like shape for serving as a kind of anvil or base for supporting a contact or terminal. Such a tool has also a movable head that is indirectly driven by a motor to reciprocate straight towards and away from the fixed anvil. In operation, lengths of a wire will be inserted in the contacts intermittently while the movable head remains at its retracted position, before it strikes and crimps the contact on the wire end. A flexible band carrying those contacts at regular intervals like usual chains will be rolled up and mounted on the crimper, and the motor is installed therein together with a speed reducer.

The electric contacts carried by the flexible band must timely be delivered one by one to a crimping station of the crimper while the movable head is at its retracted position. It is therefore desirable to provide the crimper with an accurately working feed controller, and to render same smaller-sized in view of a considerably large space usually occupied by the rolled band of contacts and the motor with a reduced size.

Every contact transferred to the crimping station must not be displaced by a wire end which is being inserted into the contact, lest the crimping effect should take place at a wrong portion thereof. There is another requirement that every crimped contact has to be withdrawn easily and surely from the concave portions at the crimping station so as not to be struck twice in error. Further, there has been a possibility that the wire end would occasionally be wrongfully inserted into some succeeding contacts not having arrived at the station. In such an event, the leading correct contact would be struck without the wire end inserted therein, thus causing the loss of material and interrupting a smooth sequence of normal operation steps.

SUMMARY OF THE INVENTION

Therefore a primary object of the present invention is to provide a motor-driven portable crimper constructed such that a contact feeder incorporated therein operates to supply electric contacts carried on a band one by one to a crimping station and at a correct timing linked with the motion of a crimping head. In this crimper, the crimping head and other movable members must automatically stand still for a while relative to a fixed jaw serving as an anvil disposed at the station so that the end of every length of an electric wire can be inserted readily into the contact after it has been gripped by and between the head and anvil. After the contact is struck and pressed, the movable head will be retracted to its inoperative position and has to be automatically kept there again for a while so that the crimped contact with the wire end can easily be withdrawn from the crimping station.

It is a further object of the present invention to provide the motor-driven portable crimper of a structure as summarized above and further comprising a foolproof means for ensuring that every wire end be inserted only into a correct contact.

In order to achieve the primary object, the present motor-driven portable crimper proposed herein does comprise a crimping station defined in a frame, the station consisting of a movable head and a stationary anvil, the movable head linearly reciprocating within the frame towards and away from the stationary anvil, the crimper further comprising a primary cam fixed on a common cam shaft which is rotated by a motor at a lowered moderate speed preferably through a planetary gear train, and the primary cam driving the movable head, wherein all the members except for the motor are housed in the frame. The crimper also comprises a contact feeder that is driven by a secondary cam fixed on the cam shaft in such a manner that the leading end of a band holding longitudinally thereof a series of the contacts at regular intervals will come into the station intermittently by one pitch for every cycle of operation. The crimper further comprises an automatic switch that detects a rearward position of the movable head retracted from the stationary anvil and also a forward position of the head extended towards and having approached the anvil such a distance that the contact is temporarily gripped between said head and anvil, so that upon detection of these positions the motor will automatically be turned off. In addition, a manual switch for manually and voluntarily turning on the motor is provided in the crimper.

Preferably, the automatic switch cooperates with the secondary cam to be opened and closed thereby.

In order to achieve the further object, the crimper may have a blind plate attached to and outside the frame. This blind plate has to be disposed near the crimping station so as to inhibit a user from erroneously insert wire ends to any wrong contacts which have not yet arrived at the station.

Generally, it is preferable to dispose the relatively heavy electric motor outside the frame as noted above in order to render the crimper lighter in weight, smaller in size, easier to handle and control and convenient to various maintenance works. However, it may be accommodated in the frame, if necessary or so desired.

DESCRIPTION OF THE PREFERRED EMBODIMENTS

Figure 1:
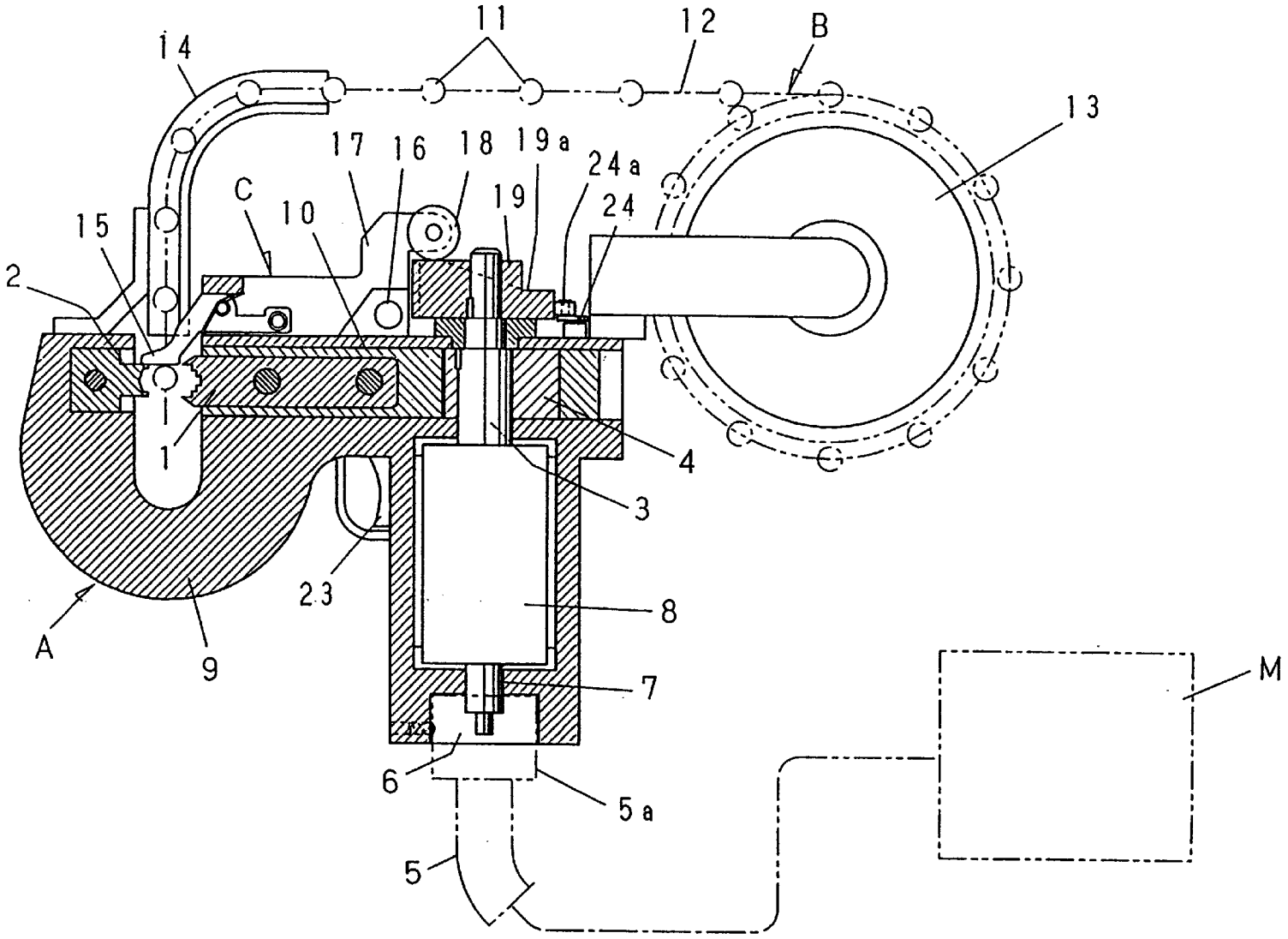
FIG. 1 is a vertical cross section of a motor-driven portable crimper provided in a first embodiment.
Figure 2:
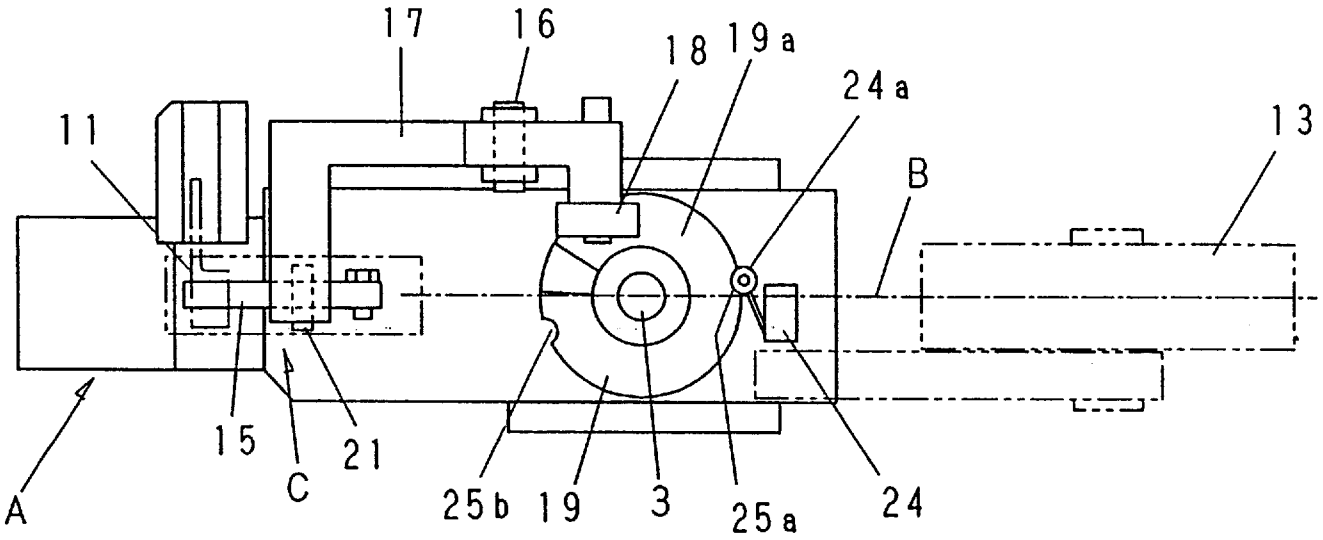
FIG. 2 is a plan view of the crimper.

Now some embodiments of a motor-driven portable crimper of the present invention will be described in detail referring to the drawings. The crimper generally indicated by the symbol 'A' has a crimping station that comprises of a stationary anvil 2 embedded in a frame 9 and a movable head 1 reciprocating therein towards and away from the anvil 2. A plunger 10 fitting on and integral with the movable head has a rear end bearing against a primary cam 4 fixed on a cam shaft 3. As the cam shaft 3 rotates, the movable head 1 will make a linear stroke towards and away from the stationary anvil 2.

A middle or main portion of the frame 9 is formed as a handle of this crimper 'A'. The cam shaft 3 as well as a planetary gear train 8 for driving same are housed in the main portion. An input shaft 7 of the gear train extends into a joint 6 that is opened outwardly in the bottom of said frame.

An electric motor 'M' as the power source is disposed outside the crimper 'A'. A flexible transmission tube 5 extends from the motor and terminates as a coupler 5*a* that is detachably engageable with the joint 6.

Contacts 11 are made of a conductive metal plate and arranged in parallel with each other at regular intervals to form a belt 'B' to be wound on a reel 13.

The free end of the belt 'B' being unwound from the reel 13 and moving through and along a guide path 14 will advance in between the stationary anvil 2 and the movable head 1. A contact feeder 'C' linked with the head will cause the belt to move in an intermittent matter, one pitch for every cycle of operation, whereby the leading contact 11 can take a correct position at the crimping station.

Figure 3:
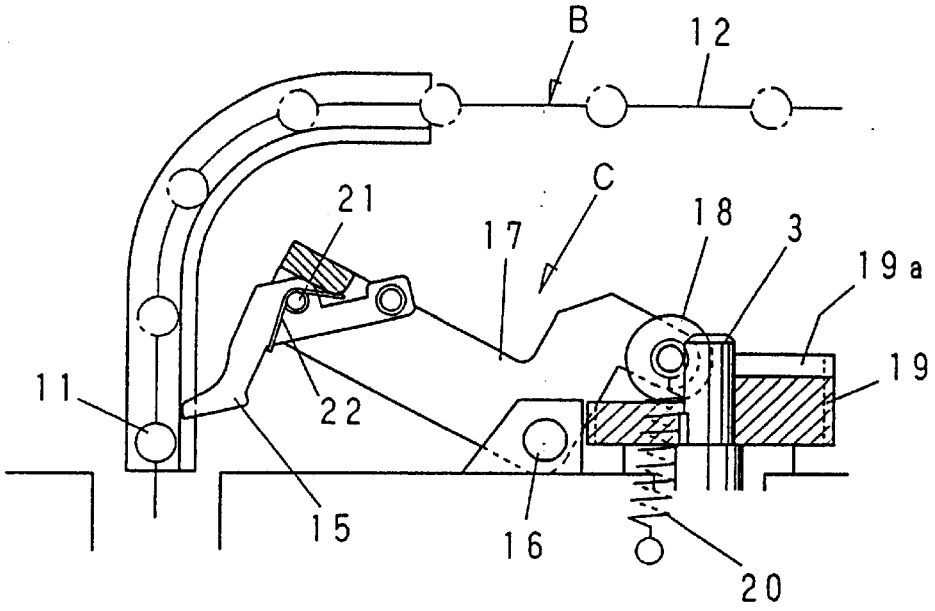
FIG. 3 is a front elevation of a contact feeder included in the crimper and shown at a larger scale and partly in cross section.
Figure 4:
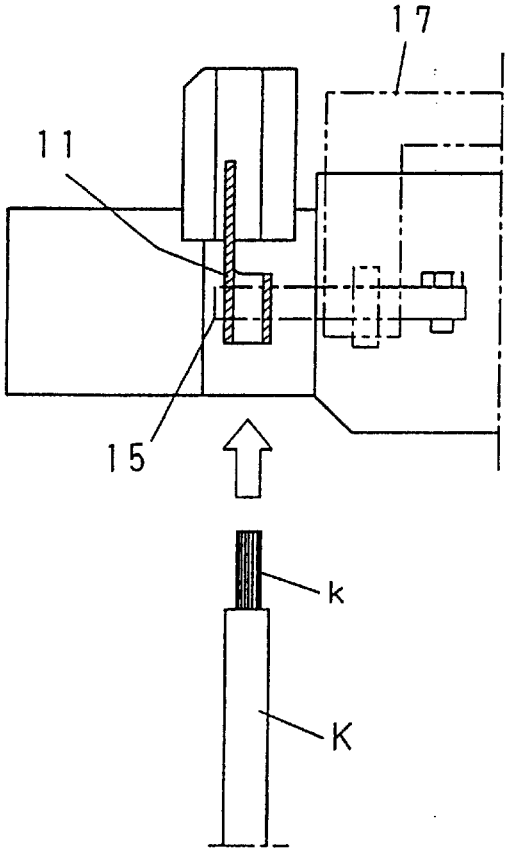
FIG. 4 is a plan view of some principal parts of the crimper.
Figure 5:
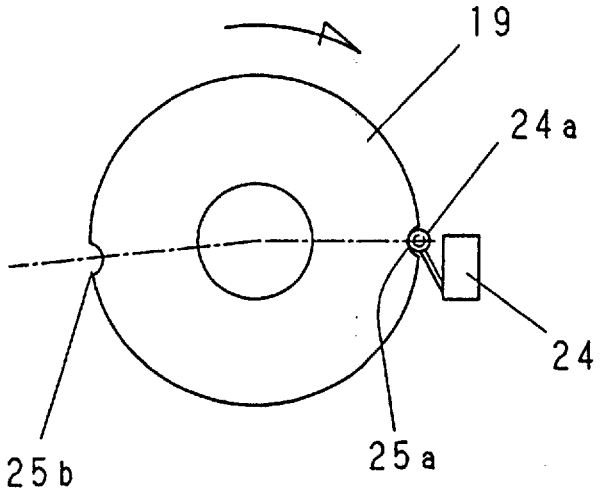
FIG. 5 is a plan view of a secondary cam included in the crimper and cooperating with an automatic switch.

As will be seen in FIG. 3, the contact feeder 'C' includes a rockable arm 17 and a secondary cam 19. The arm has at its forward end a pawl 15, at its rearward end a cam follower 18 and a middle portion connected by a pivot 16 to the frame 9. The secondary cam 19 fixed on an uppermost portion of the cam shaft 3 has an upper oblique circular face 19*a*. A spring 20 urges downwards the cam follower 18 to be always in contact with the upper oblique face so that one rotation of the secondary cam will force the rockable arm 17 to make one reciprocation of swinging up and down. A pivot 21 connects the pawl 15 at its middle portion to the forward end portion of the rockable arm, thus enabling the pawl to rock between its operative position engaging with the contact 11 (as shown in FIG. 1) and its idle position (shown in FIG. 3). As the arm 17 is driven downwards from its higher position shown in FIG. 3 to its lower position shown in FIG. 1, the pawl 15 will be forced to take its operative position against the spring 22 urging it downwards. Hence, the leading contact 11 whose upper surface has come into contact with the claw will be pushed down until it takes a position shown in FIG. 1. The movable head 1 remains at its retracted position shown in FIG. 1 while the pawl 15 is pressing down the leading contact 11, but the movable head will move forward to crimp the contact while the pawl is at its upper idle position. The cams 4 and 19 are shaped to ensure such motions of the members.

Figure 6:
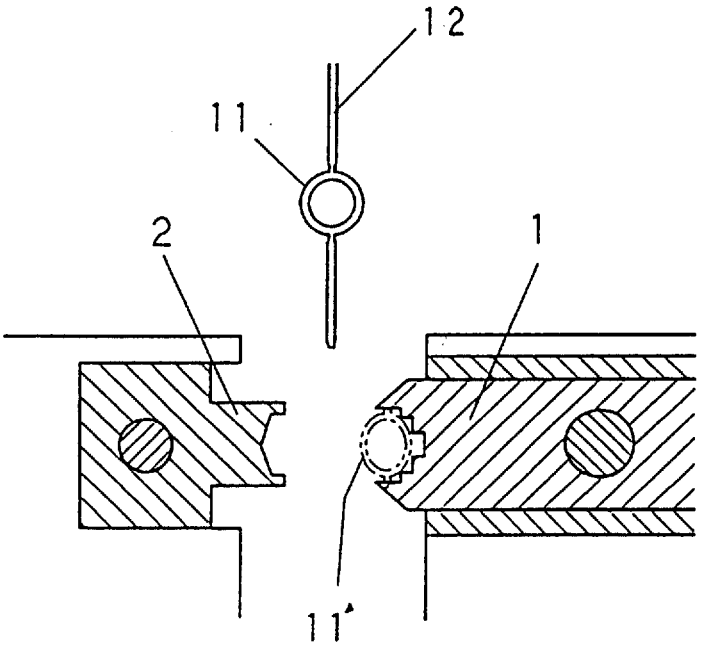
FIG. 6 is a vertical cross section of a movable head also included in the crimper and retracted away from a stationary anvil to receive between them a contact.
Figure 7:
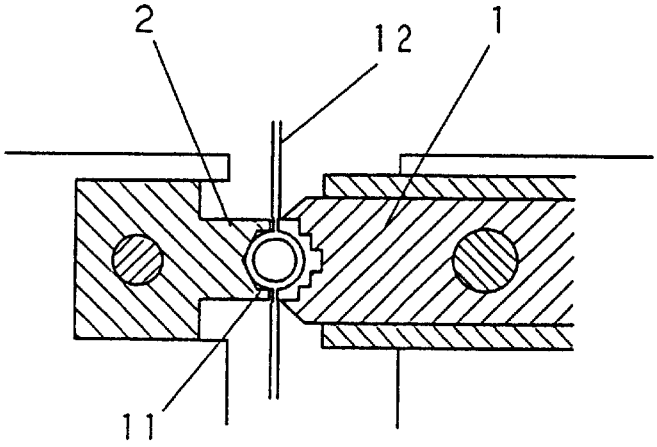
FIG. 7 is similarly a cross section of the movable head that has approached the anvil to temporarily grip the contact.
Figure 8:
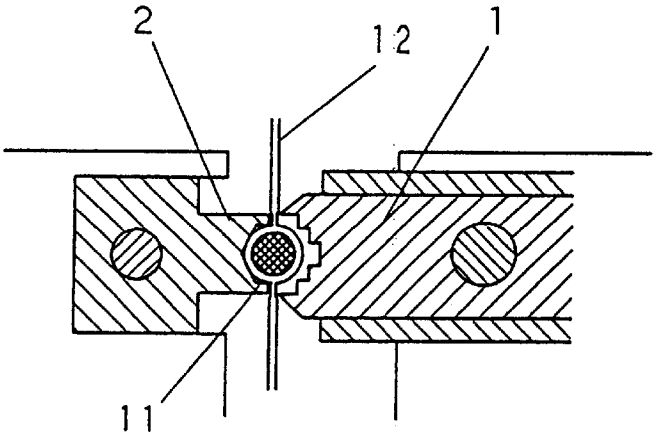
FIG. 8 is also a cross section similar to FIG. 7 but showing an end of wire inserted in the contact.

The crimper further comprises an automatic switch 24 that detects the rearward position of the movable head 1 retracted from the stationary anvil 2 (shown in FIG. 6) and also the forward position of the head extended towards the anvil such a distance that the contact 11 is temporarily gripped between said head and anvil (shown in FIG. 7). Upon detection of these positions the motor 'M' will automatically be turned off. A manual switch 23 is also provided to manually and voluntarily turn on the motor. The automatic switch 24 is disposed near and facing the periphery of the secondary cam 19, and its small contact roll 24*a* can engage with either cutout 25*a* and 25*b* to be activated to turn off the motor. One of the cutouts 25*a* corresponds to the movable head's retracted position shown in FIG. 6, with the other cutout 25*b* corresponding to the extended position temporarily griping the contact 11 as shown in FIG. 7.

Figure 9:
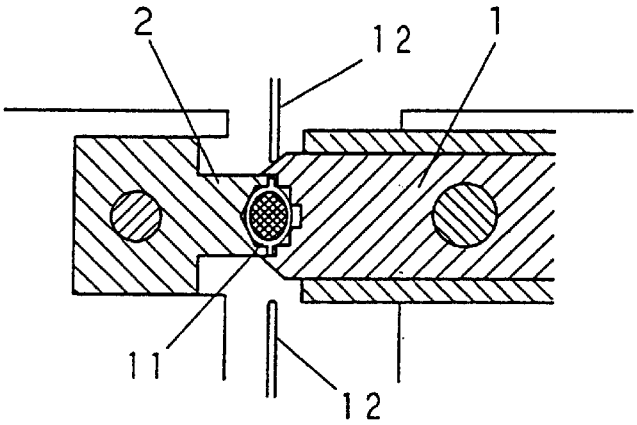
FIG. 9 is a cross section of the movable head just cooperating with the anvil to crimp the contact on the wire end.

When the members are in a state shown in FIG. 6 and the crimping station is opened, the manual switch 23 may be turned on to activate the motor 'M' to consequently move the leading contact 11 in between the head 1 and the anvil 2 until the contact is temporarily gripped thereby and the other switch's contact roller 24*a* then fitting in the cutout 25*b* stops the motor 'M'. A bare end 'k' of the length of wire 'K' will subsequently and easily be inserted into the contact 11 temporarily retained still in position so that it will not be displaced unintentionally by the wire end being inserted. Thereafter, the manual switch 23 will be turned on again so that the thus activated motor 'M' forces the movable head 1 to further move ahead to its foremost position shown in FIG. 9 where bond 12 (preferably made of a plastics) connecting the contacts 11 to each other is severed and the leading contact is crimped on the wire end. Subsequent to this operation, the head will return to its retracted position FIG. 6) where the contact roller 24*a* fits again in the cutout 25*b* of the secondary cam 19 so as to stop the motor 'M'. At this stage, the contact 11' occasionally and undesirably sticking to the concave surface of the movable head or stationary anvil may be removed easily, prior to repetition of the abovedescribed steps.

In this embodiment, the heavy electric motor 'M' is disposed outside the frame 9 so as to render the crimper lighter in weight, smaller in size, easier to handle and control and convenient to various-maintenance operations. It may however be housed in the frame 9, if necessary and depending on the circumstances.

The secondary cam 19 has the cutouts 25*a* and 25*b* for cooperation with the automatic switch 24 in the embodiment. Alternatively, they may be disposed on any other part such as the primary cam 4 that rotates in unison with the cam shaft 3.

Figure 10:
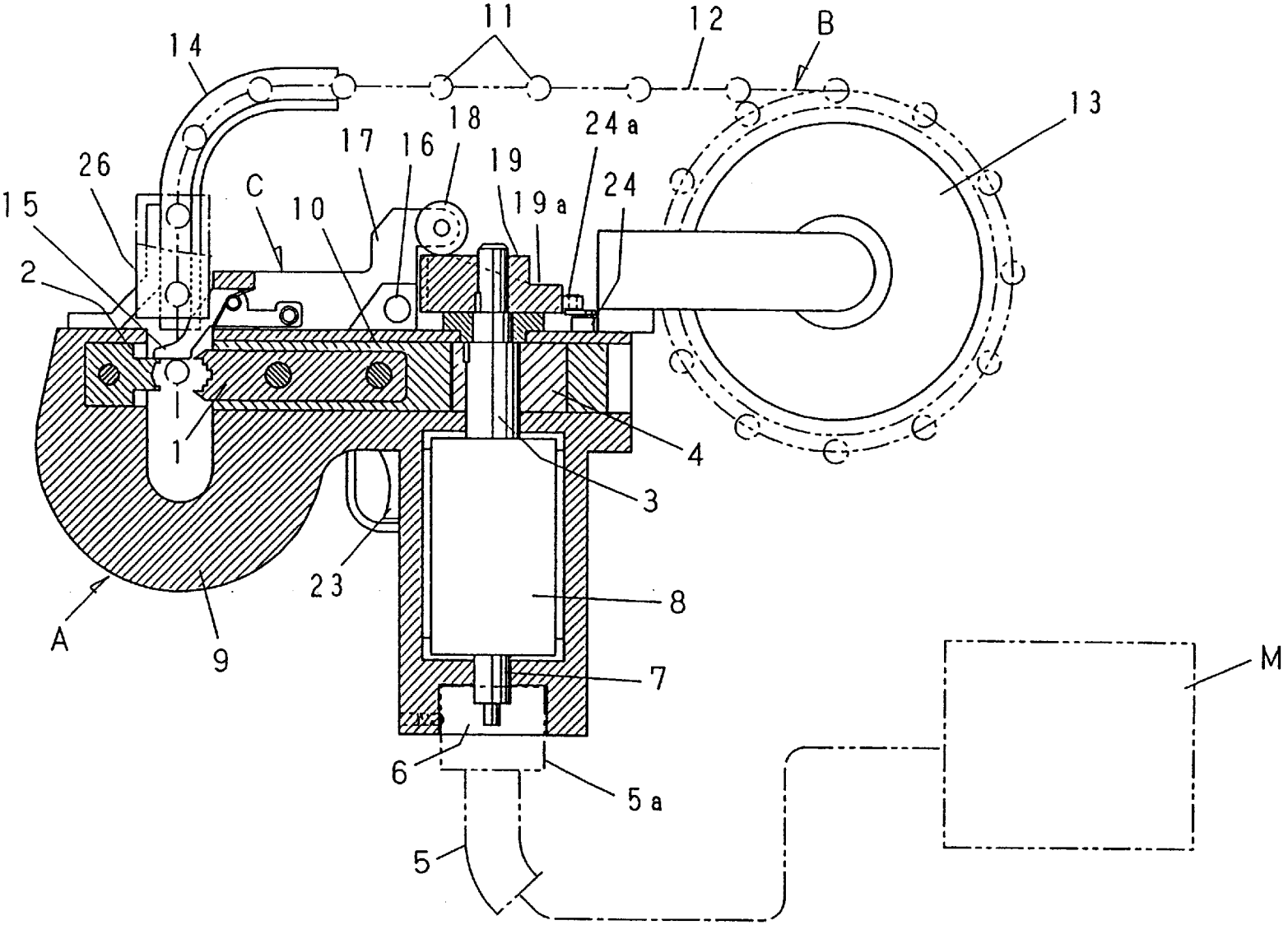
FIG. 10 is a vertical cross section of a motor-driven portable crimper provided in a second embodiment and having a blind plate that is disposed near the crimping station.
Figure 11:
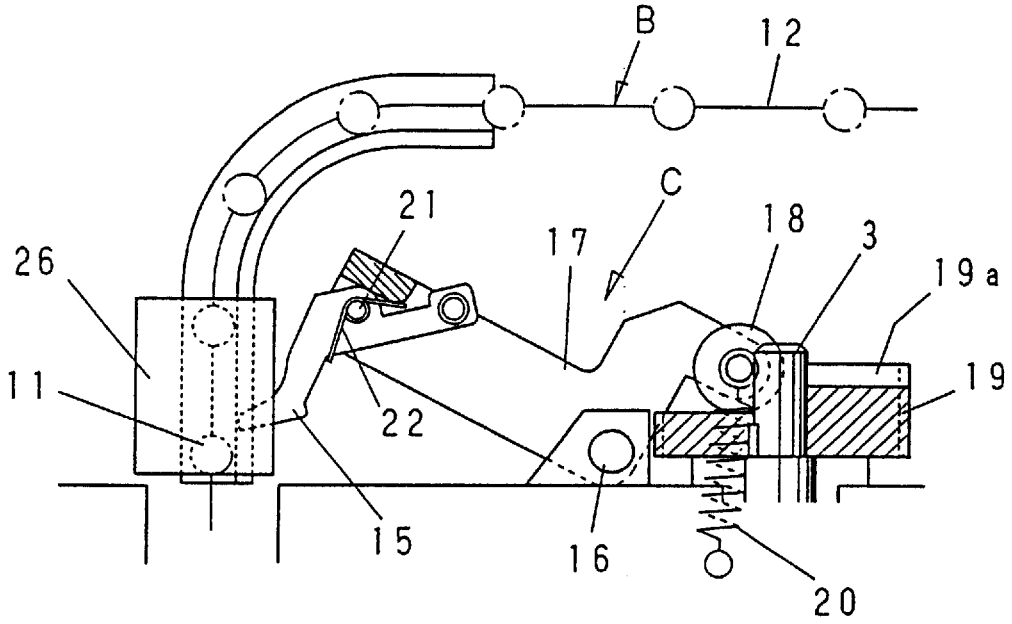
FIG. 11 is a front elevation of a contact feeder included in the crimper of FIG. 10 and shown at a larger scale and partly in cross section.
Figure 12:
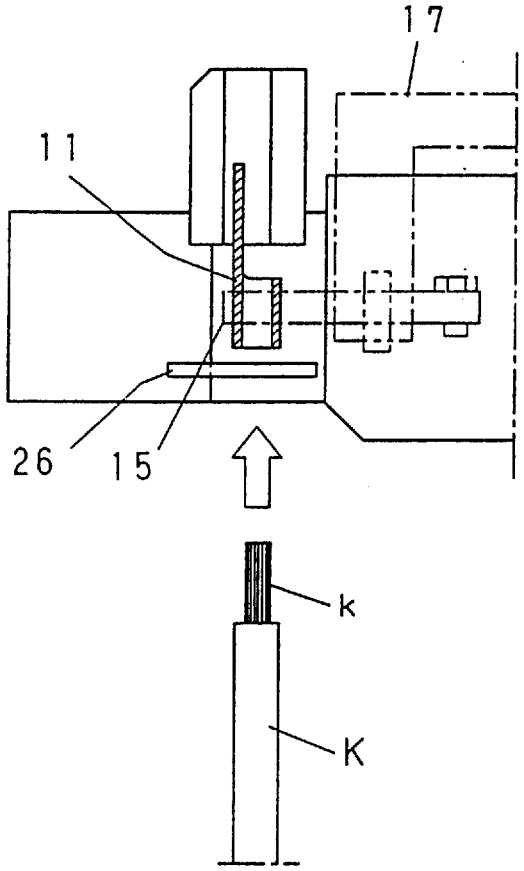
FIG. 12 is a plan view of some principal parts of the crimper shown in FIG. 10.

In a second embodiment shown. in FIGS. 10 to 12, the crimper further comprises a blind plate 26 attached to and outside the frame. This blind plate is fixed on the frame 9 at a location adjacent to the crimping station composed of the movable head 1 and stationary anvil 2. The blind plate 26 disposed upstream of the direction of inserting the wire end such that the side openings of contacts 11 not having arrived at the station are blocked.

Such a masking blind plate 26 is effective to protect the succeeding contacts from accidentally receiving any wire end while the leading one is just undergoing the crimping process.

Thus, any error of inserting the wire ends to the wrong contacts which have not arrived at the station will be avoided in a foolproof manner.

It will be understood that any details including the outer configuration of the crimper and the structure of the joint described above may be modified in any manner so long as the objects and features of the present invention are achieved or ensured.

In summary, the crimper is so designed that all the moving parts automatically stop at first when the leading contact is temporarily gripped by and between the movable head and the stationary anvil of the crimping station, and subsequently when the head is retracted after having crimped the contact at the station. This feature is advantageous in that the wire will easily be inserted into the fresh empty contact and in that any crimped contact sticking to the concave faces of the crimping members may be removed without any difficulty so as to avoid any double crimping of the same contact. The single cam shaft driving both the crimping members and the contact feeder enables the timings of their movement and stopping to be linked with each other accurately and easily, thus simplifying the drive mechanism as a whole in the crimper.

In addition, the masking blind plate is effective to protect the succeeding contacts from receiving in error any wire end while the leading one is just undergoing the crimping process, thereby avoiding the false crimping of empty contacts.

The foregoing relates to preferred exemplary embodiments of the invention, it being understood that other variants and embodiments thereof are possible within the spirit and scope of the invention, the latter being defined by the appended claims.

What we claim is:

1. A motor-driven portable crimper comprising:

a crimping station defined in a frame and composed of a movable head and a stationary anvil;

the movable head linearly reciprocating within the frame towards and away from the stationary anvil so that contacts are crimped on ends of an electric wire;

a primary cam that drives the movable head and fixed on a cam shaft which is rotated by a motor at a lowered speed through a planetary gear train;

a contact feeder that is driven by a secondary cam also fixed on the cam shaft in such a manner that a leading end of a band holding longitudinally thereof a series of the contacts at regular intervals will come into the crimping station intermittently by one pitch for every cycle of operation;

an automatic switch that detects a rearward position of the movable head retracted from the stationary anvil and also a forward position of the head extended towards the anvil such a distance that the contact is temporarily gripped between said head and anvil without substantially crimping the contact, so that upon detection of these positions the motor will automatically be turned off; and a manual switch for manually and voluntarily turning on the motor to crimp the contact.

2. A motor-driven portable crimper as defined in claim 1, wherein the automatic switch cooperates with the secondary cam to be opened and closed thereby.

3. A motor-driven portable crimper as defined in claim 2, wherein all the members except for the motor are accommodated in the frame.

4. A motor driven portable crimper as defined in claim 2, further comprising a blind plate attached to and outside the frame, the blind plate being disposed near the crimping station so as to prevent wire ends from being inserted into the contacts which have not arrived at the station.

5. A motor driven portable crimper as defined in claim 3, further comprising a blind plate attached to and outside the frame, the blind plate being disposed near the crimping station so as to prevent wire ends from being inserted into the contacts which have not arrived at the station.

* * * * *